US005450174A

United States Patent [19]

Osbourne et al.

[11] Patent Number: 5,450,174

[45] Date of Patent: Sep. 12, 1995

[54] LAMP PROTECTIVE COVER

[75] Inventors: William G. Osbourne, Webster; Gerald J. Cavaliere, Fairport; Julio A. Sanchez-Baños, Webster, all of N.Y.

[73] Assignee: Xerox Corporation, Stamford, Conn.

[21] Appl. No.: 297,079

[22] Filed: Aug. 29, 1994

[51] Int. Cl.[6] ..... G03G 15/04

[52] U.S. Cl. ..... 355/229; 355/215; 355/228

[58] Field of Search ..... 355/215, 218, 228, 229

[56] References Cited

U.S. PATENT DOCUMENTS 4,255,042 3/1981 Armitage, Jr. et al. ..... 355/218
4,723,150 2/1988 Lutus et al. ..... 355/215
4,767,172 8/1988 Nichols et al. ..... 350/96.18
4,837,598 6/1989 Nonami ..... 355/218
4,963,933 10/1990 Brownlee ..... 355/218
5,030,992 7/1991 Yoneda et al. ..... 355/218
5,300,985 4/1994 Demott et al. ..... 355/218

*Primary Examiner*—William J. Royer
*Attorney, Agent, or Firm*—Denis A. Robitaille

[57] ABSTRACT

A lamp system for erasing an electrically charged photoconductive surface including an optically transmissive protective cover fabricated from a polypropylene adhesive tape for being affixed to a segmented surface so as to eliminate exposed gaps in which contaminants may collect and for providing a smooth surface which can be cleaned more efficiently and effectively.

18 Claims, 2 Drawing Sheets

LAMP PROTECTIVE COVER

Figure 1:
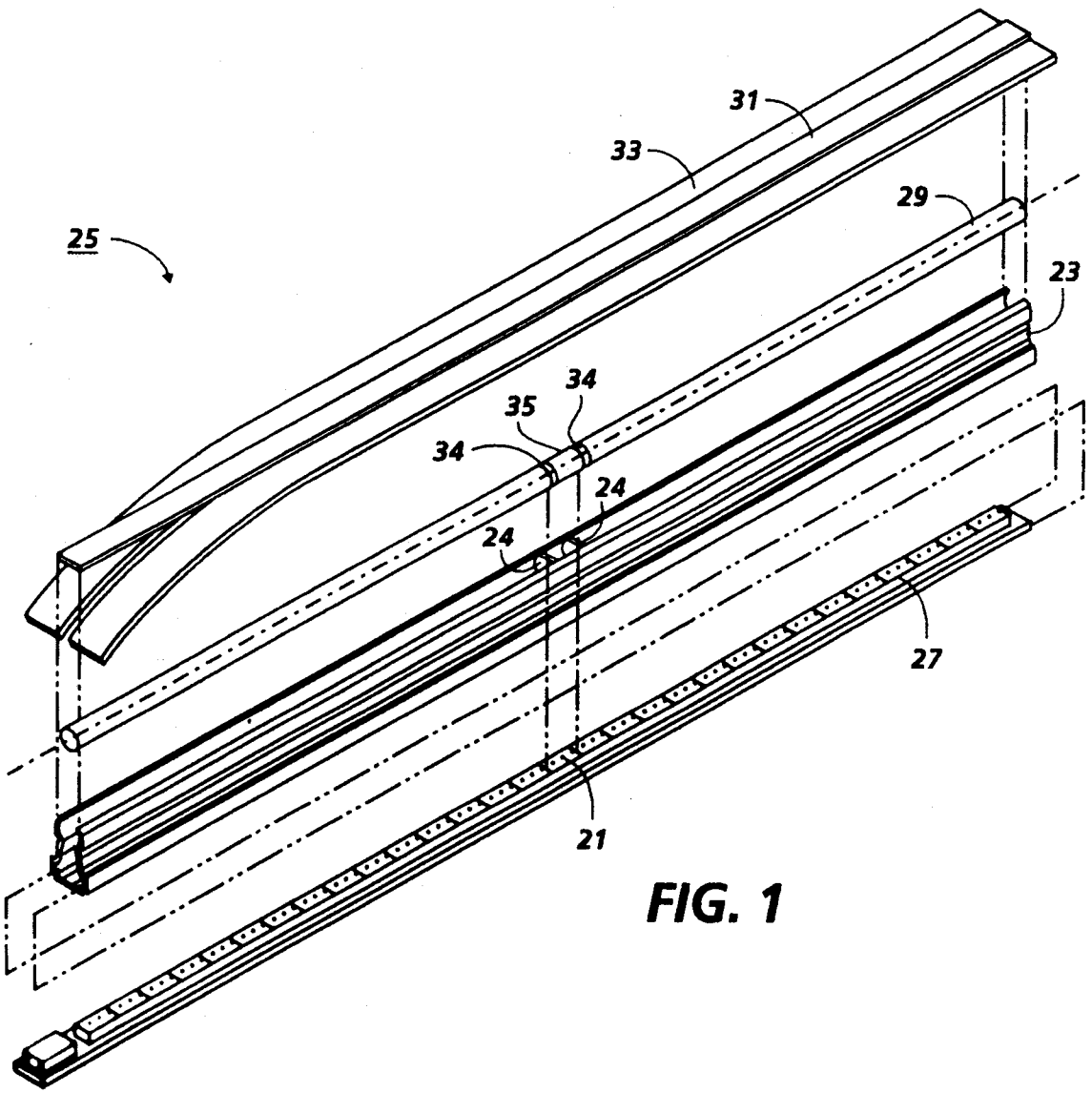

The present invention relates generally to an electrophotographic printing machine, and, more specifically, concerns an apparatus for protecting and maintaining a contamination free environment surrounding the surface of an illumination lamp, in particular an interdocument lamp used for removing unwanted charge from selected areas of a charged photoconductive member in an electrophotographic printing machine.

In a typical electrophotographic copying or printing machine, a photoconductive member is initially charged to a substantially uniform potential. The charged portion of the photoconductive member is exposed to a light image of an original document being reproduced so as to selectively dissipate the charge on the photoconductive member in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

In the electrophotographic process described hereinabove, certain areas of the photoconductive member which are initially charged to a substantially uniform potential may not be used for producing the latent image. These areas include edge margin regions adjacent the sides of the latent image recorded on the photoconductive member, as well as interdocument areas such as the non-image areas situated before the first electrostatic latent image, between adjacent latent images, and after the last latent image of a series of latent images recorded on the photoconductive member. If these non-image areas remain charged, the areas are subsequently developed with toner particles. Since these toner particles are not transferred to the copy sheet, they must be cleaned from the photoconductive member prior to the next successive imaging cycle or they will degrade the copy. Preventing development of these areas reduces toner consumption and failures in the cleaning system. As a result, it has become a common practice in the art to remove charge present in non-image areas on the photoconductive member, or "erase" these charged non-image areas so that they are discharged prior to development. Thus, the non-image areas on the photoconductive member will not be developed with toner particles and there is no requirement to clean the photoconductive member in these non-image areas.

Various prior art charge erase devices are known in the art for addressing the problem of erasing undesired charge from selected areas of a photoconductive member. Typically, an illumination device such as an erase lamp is used to remove charge present in non-image areas. For example, an erase lamp extending across the the photoconductive member perpendicular to the path of movement may be energized for a selected time period as a function of the velocity of the photoconductive member so as to illuminate the entire interdocument area in order to erase the charged area between a series of latent images on the photoconductive member. The selected time of energization varies as a function of the size of the interdocument area. By contrast, edge erase requires that the length of the erase lamp be adjusted to compensate for different size images. By way of additional background, interdocument erase lamps have also been utilized for generating so called "test patches" having a predetermined voltage level on the photoconductive member in the interdocument region, wherein the voltage level of such test patches can be measured and used to adjust certain variable parameters for maintaining optimum machine operation.

Previously, the desirable erase function described above has been achieved by the use of multiple lamps or shutters. Thus, interdocument erase has been achieved by energizing a lamp extending the width of the photoconductive member for a preset time, while edge erase has been accomplished by energizing selected lamps on either side of the latent image to erase the edge areas. Using this approach, it is evident that some machine configurations may require many erase lamps to be located about the periphery of the photoconductive member for discharging selected non-image areas. In some cases, as many as five individual lamps have been used. Of course, these numerous lamps generate additional heat, and have the disadvantage of added cost and lower overall reliability.

An extensive listing of references which disclose charge erase devices used in electrophotographic applications is provided in U.S. Pat. No. 4,806,975, the contents of which are hereby incorporated by reference. That patent discloses a multifunction plasma-erase lamp which incorporates a segmented electrode, each segment being selectively energized and associated with a specific erase function (interdocument, edge erase, formation of a test patch area, etc.). In addition, U.S. Pat. No. 4,767,172, the contents of which are also incorporated by reference herein, discloses the use of LED arrays used in electrophotographic machines for test patch generation as well as for interdocument and edge erasure of the photoconductive surface. In particular, that patent makes reference to U.S. Pat. No. 4,255,042, also incorporated by reference herein, wherein a segmented light pipe is disclosed for accurate erasure of charge on a photoconductive member. More recently, multi-function erase lamps have been developed and disclosed, as for example, in U.S. Pat. No. 5,300,985, the contents of which are hereby incorporated by reference, wherein the conventional erase functions of interdocument erase and fixed edge erase, as described above, as well as other functional features such as edge shift and the production of so called "test patches", are performed via a single illumination device.

It will be appreciated from the references cited hereinabove, that various approaches have been devised for erasing unwanted charged areas of the photoconductive member while also providing means for generating test patches in the interdocument region. It will also be appreciated that ever demanding customer requirements for improved copy quality and extended product life have made it necessary to provide lamps with significantly improved light output stability, optimized spectral output and improved life characteristics. However, one significant issue relating to copy quality, as further related to interdocument lamp output stability and product life, is the problem, associated most directly with the triboelectrification process, caused by the inadvertent escape of developing material, and, in particular, liquid or dry toner particles, from the developer housing. Airborne toner particles are readily attracted to the interdocument lamp, as well as various other processing stations and machine component surfaces within the electrostatographic apparatus. In addition, paper debris and other airborne contaminants are often generated by the movement of paper or other copy substrates through the machine. Contamination of the interdocument lamp surface adversely affects machine reliability and performance as well as copy quality by yielding non-uniform exposure, increased background, and generally unacceptable copy quality, often causing unscheduled maintenance and repair by skilled field service technicians. A secondary problem, associated directly with the contamination of segmented interdocument lamps, as disclosed in previously referenced U.S. Pat. No. 4,255,042, exists in the fact that service technician cleaning of the interdocument lamp actually exacerbates the contamination problem by pushing toner particles and other debris into the narrow gaps between each segment, thereby causing permanent copy quality defects and leading to premature replacement of the interdocument lamp.

In accordance with the present invention, there is provided a lamp system for erasing an electrically charged photoconductive surface, including a light source, a lens member for allowing light rays to be uniformly propagated from the light source to the photoconductive surface, and an optically transmissive protective cover for preventing contamination of the lamp system to maintain uniform light output therefrom.

Pursuant to another aspect of the present invention, there is also provided an electrophotographic printing machine of the type in which a light source is employed to discharge selected portions of a charged photoconductive member adapted to have successive electrostatic latent images of original documents recorded thereon, wherein the light source comprises a light emitting diode (LED) array for generating light rays, a light pipe for allowing the light rays to uniformly propagate from the LED array to the photoconductive surface, and an optically transmissive protective cover for preventing contamination of the lamp system to maintain uniform light output therefrom.

Figure 2:
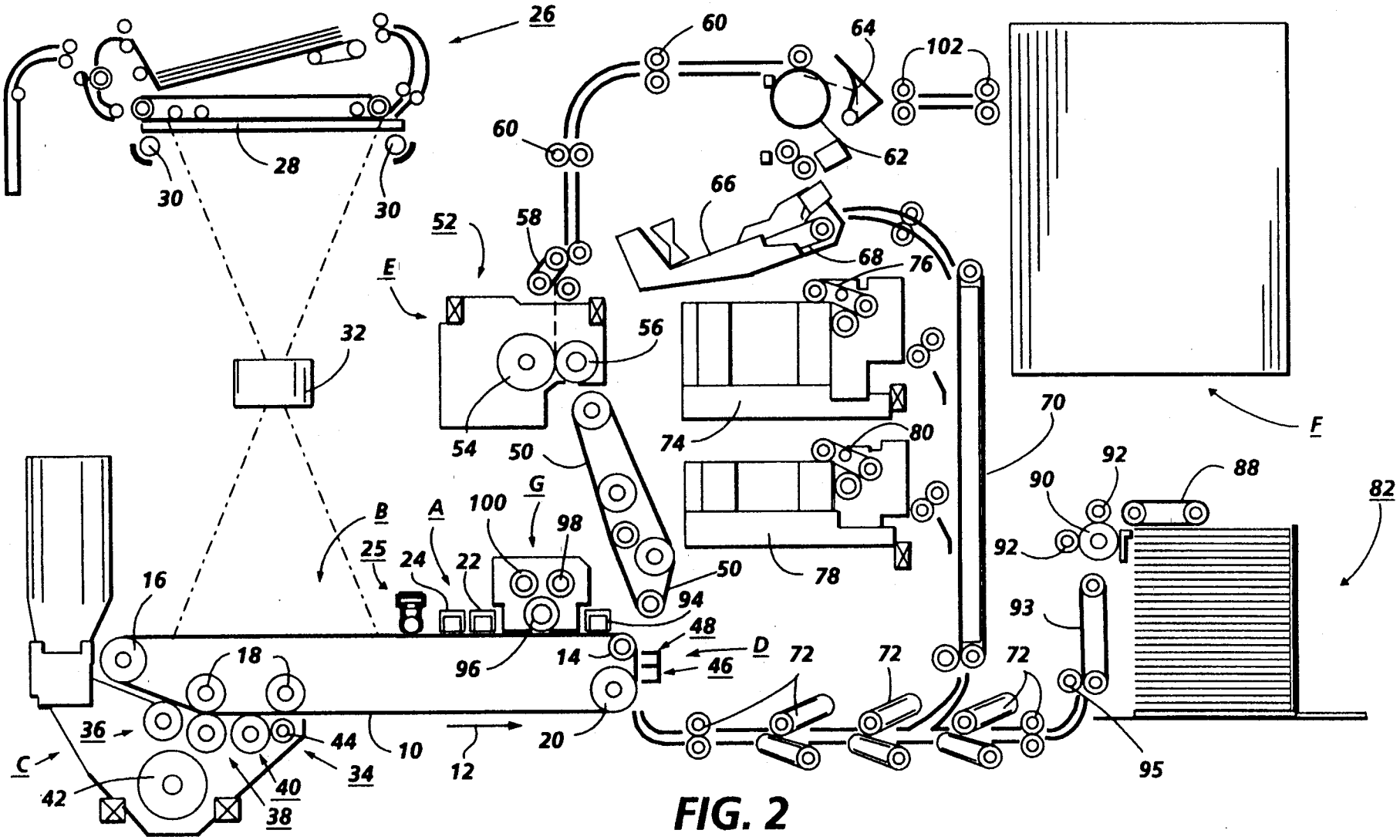

While the present invention will hereinafter be described in connection with a preferred embodiment and method of use, it will be understood that it is not intended to limit the invention to that embodiment or method of use. On the contrary, the following description is intended to cover all alternatives, modifications, and equivalents, as may be included within the spirit and scope of the invention as defined by the appended claims. Other aspects of the present invention will become apparent as the following description proceeds and upon reference to the drawings, in which:

FIG. 1 is an exploded perspective view of an interdocument lamp showing the protective lamp cover of the present invention; and FIG. 2 is a schematic elevational view depicting an illustrative electrophotographic printing machine incorporating an interdocument lamp with the protective lamp cover of the present invention.

For a general understanding of the features of the present invention, reference is made to the drawings, wherein like reference numerals have been used throughout to identify identical or similar elements. Turning initially to FIG. 2, prior to discussing the invention in detail, a schematic depiction of an exemplary electrophotographic reproducing machine incorporating various machine components is furnished in order to provide a general background and understanding of the features of the present invention. Although the apparatus of the present invention is particularly well adapted for use with a so called interdocument lamp incorporated into an automatic electrophotographic reproducing machine as shown in FIG. 2, it will become apparent from the following discussion that the lamp protective cover of the present invention is equally well suited for use in various subsystems in a wide variety of electrostatographic processing machines as well as many other known devices and apparatus in which lamp surfaces are subject to contamination. It will be further understood that the present invention is not necessarily limited in its application to the particular embodiment or embodiments shown and described herein.

The exemplary electrophotographic printing machine of FIG. 2 employs a photoconductive belt 10, preferably comprising a photoconductive material coated on a ground layer, which, in turn, is coated on an anti-curl substrate. Belt 10 is entrained about stripping roller 14, tensioning roller 16, rollers 18, and drive roller 20. Stripping roller 14 and rollers 18 are mounted rotatably so as to rotate with belt 10, while tensioning roller 16 is resiliently urged against belt 10 to maintain belt 10 under a desired tension and drive roller 20 is rotated by a motor (not shown) coupled thereto by any suitable means such as a drive belt. Thus, as roller 20 rotates, it advances belt 10 in the direction of arrow 12 to advance successive portions of the photoconductive surface of photoconductive belt 10 sequentially through the various processing stations disposed about the path of movement thereof.

Initially, a portion of photoconductive belt 10 passes through charging station A, whereat two corona generating devices, indicated generally by the reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt while filling in any areas missed by corona generating device 22.

After photoconductive belt 10 is charged, a light source, or so called interdocument lamp 25, is selectively energized to discharge the charge on the photoconductive belt 10 in selected non-image regions. Interdocument lamp 25 is situated such that its longitudinal axis extends in a direction substantially perpendicular to the direction of movement of belt 10 as indicated by arrow 12. In this way, lamp 25 extends across the width of belt 10 in order to provide the capability to erase unwanted charge between a trailing edge of one image frame and a leading edge of a subsequent image frame. Lamp 25 may also be segmented, as shown in previously referenced U.S. Pat. Nos. 4,255,042, 4,806,975 and 5,300,985. Segmenting of the interdocument lamp provides the capability to selectively erase charged areas of the photoconductive member, as, for example, edge trim areas between the side edges of an image frame and the respective sides of the photoconductive belt 10. In a specific example, a segment adjacent one end of lamp 25 can be individually controlled to discharge the region defined by the outboard edge of the photoconductive belt and the registration edge of the latent image recorded thereon. A second segment may be provided for discharging a predetermined portion of the image frame to eliminate any registration line on the copy. Yet another segment may be provided for discharging the region of the image frame in which the holes of a computer form feed document are recorded. In addition, another segment may be dedicated to enable generation of a charged test patch in the interdocument area. In this scheme, individually controlled segments can be electrically connected to one another so that the segments can be energized in unison, whereby energization of multiple segments can be utilized to erase the charge across the entire width of the interdocument area. The specific structure of the interdocument lamp and the features thereof will be discussed in detail hereinafter with reference to FIG. 1.

Next, the charged portion of photoconductive belt 10 is advanced through imaging station B. At imaging station B, a document handling unit, indicated generally by reference numeral 26, is positioned over platen 28 of the printing machine. The document handling unit 26 sequentially feeds documents from a stack of documents placed in a document stacking and holding tray such that the original documents to be copied can be loaded face up into the document tray on top of the document handling unit. Using this system, a document feeder, located below the tray, feeds the bottom document in the stack to rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28. Imaging of the document is achieved by two flash lamps 30 mounted in the optics cavity for illuminating the document on platen 28. Light rays reflected from the document are transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document. Thereafter, photoconductive belt 10 advances the electrostatic latent image recorded thereon to development station C.

At development station C, a magnetic brush developer housing, indicated generally by reference numeral 34, is provided, having three developer rolls, indicated generally by the reference numerals 36, 38 and 40. A paddle wheel 42 picks up developer material in the developer housing and delivers it to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zone. Developer roll 40 is a cleanup roll and magnetic roll 44 is a carrier granule removal device adapted to remove any carrier granules adhering to belt 10. Thus, foils 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet (not shown) is moved into contact with the toner powder image on belt 10. The developed image on belt 10 contacts the advancing sheet of support material in a timed sequence and is transferred thereon at transfer station D. As can be seen in the illustrated embodiment, a corona generating device 46 charges the copy sheet to a proper potential so that the sheet is electrostatically secured or "tacked" to belt 10 and the toner image thereon is attracted to the copy sheet.

Copy sheets may also be fed to transfer station D from a secondary tray 74 which includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by a sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from an auxiliary tray 78. As in the case of the secondary tray 74, the auxiliary tray 78 includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are supplemental sources of copy sheets. A high capacity feeder, indicated generally by the reference numeral 82, is the primary source of copy sheets. High capacity feeder 82 which may include a tray supported on an elevator (not shown), wherein the elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D After transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller 56 abuts the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together. Alternatively, duplex solenoid gate 64 diverts the sheet into duplex tray 66, providing intermediate storage for those sheets that have been printed on one side and on which an image will be subsequently printed on the second, opposed side thereof, i.e. the sheets being duplexed. The sheets are stacked in duplex tray 66 face down on top of one another in the order in which they are copied. In order to complete duplex copying, the simplex sheets in tray 66 are fed, in seriatim, by a bottom feeder 68 from tray 66 back to transfer station D, via conveyor 70 and rollers 72, for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F via transport rollers 102.

Invariably, after the copy sheet is separated from photoconductive belt 10, some residual particles remain bonded thereto. After transfer, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt 10 in preparation for the next charging cycle. Residual particles are removed from the photoconductive surface at cleaning station G. Cleaning station G may include an electrically biased cleaner brush 96 and two waste and reclaim de-toning rolls 98 and 100. The reclaim roll 98 is electrically biased negatively relative to the cleaner roll 96 so as to remove toner particles therefrom while the waste roll 100 is electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by a controller (not shown) which is preferably a programmable microprocessor which manages all of the machine functions hereinbefore described. Among other things, the controller provides a comparison count of the copy sheets, the number of documents being recirculated, the number of copy sheets selected by the operator, time delays, jam indications and interdocument lamp timing information. The operation of all of the exemplary systems described hereinabove may be accomplished by conventional user interface control switch inputs from the printing machine consoles selected by the operator. Conventional sheet path sensors or switches may be utilized to keep track of the position of documents and the sheets in the machine. In addition, the controller regulates the various positions of gates and switching depending upon the mode of operation selected.

The foregoing description should be sufficient for the purposes of the present application for patent to illustrate the general operation of an electrophotographic reproducing apparatus incorporating the features of the present invention. As previously discussed, the electrophotographic reproducing apparatus may take the form of any of several well known systems or machines such that variations of specific electrostatographic processing subsystems or processes may be expected without affecting the operation of the present invention.

Moving now to FIG. 1, an exemplary interdocument lamp 25 including an array of light emitting diodes (LEDs) 27 situated in an extruded housing 23 and positioned adjacent to a segmented light propagating lens or so called light pipe 29 is shown. Light pipe 29 comprises a thin rod of plastic or glass having polished surfaces for propagating light emitted from the LED array 27 toward the photoconductive belt 10. The light pipe 29 permits propagation of light rays therethrough while causing a certain amount of light from each LED to be refracted such that the light rays tend to fill in gaps between each individual LED so as to provide for uniform light intensity exposure along the width of the photoconductor belt 10.

In the embodiment shown in FIG. 1, light pipe 29 is segmented to provide an independent light emitting component 35, corresponding to a selected LED segment 21 of the LED array 27 dedicated to the generation of a charged test patch on the photoconductive member in the interdocument area. Segmentation of the light pipe 29 prevents longitudinal propagation of light rays through the light pipe 29 so that light in one segment is prevented from traveling to adjacent segments, thereby creating a defined delineation of light wave propagation within the light pipe 29, as well as in the area of exposure on the photoconductor belt 10. Segmentation of the light pipe 29 may be accomplished passively via simple separation of individual segments such that air gaps generally identified by reference numeral 34 exist between individual segments. Alternatively, separators generally identified by reference numeral 24 such as opaque fins or aluminized polyester blocks may be inserted between each segment to provide segmentation in the light pipe 29. It will be understood that various additional segments may be provided in the light pipe 29 for selectively erasing specific charged areas of the photoconductive belt, as previously described hereinabove.

The present invention is directed toward providing the exemplary interdocument lamp 25 having a segmented light pipe 27, as described above, with an optically transmissive, protective cover 31 for eliminating exposed gaps in which contaminants may collect and providing a smooth surface which can be cleaned more efficiently and effectively while maintaining the segmentation aspect of the segmented light pipe by preventing longitudinal propagation of light rays.

In a preferred embodiment, cover 31 of the present invention is provided in the form of a scratch resistant polypropylene film type adhesive tape designed to be applied directly to the surface of the segmented light pipe 29, such as, for example, J-LAR, a registered trademark of Permacel, Inc. of New Brunswick, N.J., U.S.A. Various other known products such as cellophane or acetate may also be suitable in certain operating environments. In the preferred embodiment, the material selected for use as the lamp cover 31 is particularly resilient, scratch resistant and intractable to drying with age or due to heat exposure. The film thickness is preferably approximately 1.25 mils in thickness, with a tensile strength of about 18 lbs./inch and a shrinkage rate on the order of 0% at 100 degrees Celsius. Most importantly, the protective lamp cover of the present invention is fabricated from a material and within operating specifications such that light propagation in the longitudinal direction can be eliminated, whereby individual segmentation of the LED array 27 can be exploited as described herein.

Another important feature of the present invention is derived from the fact that the lamp cover 31 is provided as a field replaceable tape strip, with an adhesive acrylic backing supported on a peelably removable substrate 33. This feature allows the protective cover 31 to be easily installed on the lamp assembly at the machine location and does not require the use of any additional tools and/or equipment in order to affix the cover 31 into position on the lamp assembly. As such, a service technician can easily affix of the protective cover 31 to the light pipe 29 by removing the tape strip from the peelable substrate 33, aligning the cover on the light pipe 29 and lightly pressing the cover 31 along the complete length of the light pipe 29 to assure proper adhesion thereto.

In review, the interdocument lamp of the present invention includes an optically transmissive, protective cover fabricated from a polypropylene adhesive tape has been designed to be applied to the surface of a segmented light pipe for eliminating exposed gaps in which contaminants may collect and providing a smooth surface which can be cleaned more efficiently and effectively. Although the lamp cover of the present invention has been described with respect to a segmented interdocument lamp of the type including an LED array and a light pipe, it will be understood that the lamp cover may be used in various applications which may include, for example, interdocument lamps which are not segmented or do not include LED arrays, as well as lamps in general, not specifically interdocument lamps or even lamps used in electrophotographic applications.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. A lamp system for erasing an electrically charged photoconductive surface, comprising:

a light source including a plurality of individually controllable light segments for erasing selected portions of the charged photoconductive surface;

a lens member for allowing light rays to be uniformly propagated from said light source to the photoconductive surface, wherein said lens member includes a plurality of individual lens segments corresponding to selected segments of said plurality of individually controllable light segments; and an optically transmissive protective cover for preventing contamination of said lamp system to maintain uniform light output therefrom.

2. The lamp system of claim 1, wherein:

said light source includes a test patch generating light segment for generating a test patch on a selected portion of the charged photoconductive surface; and said lens member includes a lens segment corresponding to said test patch generating light segment for providing delineation of the light rays propagated thereby.

3. The lamp system of claim 1, wherein each of said plurality of individual lens segments is separated by an air gap.

4. The lamp system of claim 1, wherein each of said plurality of individual lens segments is separated by a separator element.

5. The lamp system of claim 1, wherein said protective cover includes an optically transmissive film.

6. The lamp system of claim 5, wherein said optically transmissive film includes a polypropylene film material.

7. The lamp system of claim 5, wherein said optically transmissive film includes an adhesive layer for affixing said protective cover to said lens member.

8. The lamp system of claim 7, wherein said optically transmissive film further includes a removable substrate for facilitating affixation of said protective cover to said lens member.

9. The lamp system of claim 1, further including a housing for supporting said light source in fixed relation to said lens member.

10. An electrophotographic printing machine of the type in which a light source is employed to discharge selected portions of a charged photoconductive member adapted to have successive electrostatic latent images of original documents recorded thereon, wherein the light source comprises:

a light emitting diode (LED) array for generating light rays, wherein said LED array includes a plurality of individually controllable LED segments for erasing selected portions of the charged photoconductive member;

a light pipe for allowing the light rays to uniformly propagate from said LED array to the photoconductive member, wherein said light pipe includes a plurality of individual light pipe segments corresponding to selected segments of said plurality of individually controllable LED segments; and an optically transmissive protective cover for preventing contamination of the light source to maintain uniform light output therefrom.

11. The electrophotographic printing machine of claim 10, wherein:

said LED array includes a test patch generating segment for generating a test patch on a selected portion of the charged photoconductive surface; and said light pipe includes a light pipe segment corresponding to said test patch generating segment for providing delineation of the light rays propagated thereby.

12. The electrophotographic printing machine of claim 10, wherein each of said plurality of individual light pipe segments is separated by an air gap.

13. The electrophotographic printing machine of claim 10, wherein each of said plurality of individual light pipe segments is separated by a separator element.

14. The electrophotographic printing machine of claim 10, wherein said protective cover includes an optically transmissive film.

15. The electrophotographic printing machine of claim 14, wherein said optically transmissive film includes a polypropylene film material.

16. The electrophotographic printing machine of claim 14, wherein said optically transmissive film includes an adhesive layer for affixing said protective cover to said light pipe.

17. The electrophotographic printing machine of claim 16, wherein said optically transmissive film further includes a removable substrate for facilitating affixation of said protective cover to said light pipe.

18. The electrophotographic printing machine of claim 10, further including a housing for supporting said LED array in fixed relation to said light pipe.

* * * * *